US006487536B1

(12) United States Patent
Koezuka et al.

(10) Patent No.: US 6,487,536 B1
(45) Date of Patent: Nov. 26, 2002

(54) TIME-AXIS COMPRESSION/EXPANSION METHOD AND APPARATUS FOR MULTICHANNEL SIGNALS

(75) Inventors: Shinji Koezuka, Hamamatsu (JP); Kazunobu Kondo, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 76 days.

(21) Appl. No.: 09/598,091

(22) Filed: Jun. 21, 2000

(30) Foreign Application Priority Data

Jun. 22, 1999 (JP) ..... 11-175439

(51) Int. Cl.[7] ..... G10L 19/00; G10H 7/00
(52) U.S. Cl. ..... 704/500; 704/503; 84/612
(58) Field of Search ..... 84/612, 682; 704/500, 704/503; 434/307 A

(56) References Cited

U.S. PATENT DOCUMENTS 6,232,540 B1 * 5/2001 Kondo ..... 84/612

FOREIGN PATENT DOCUMENTS

JP 5297891 11/1993 ..... G10L/3/02
JP 10282963 10/1998 ..... G10H/7/00

* cited by examiner

*Primary Examiner*—Susan McFadden
(74) *Attorney, Agent, or Firm*—Pillsbury Winthrop LLP

(57) ABSTRACT

A time-axis compression/expansion system compresses or expands a multichannel signal at a specified compression/expansion rate. Waveform segments are sequentially cut out from each channel signal. A cutting starting point of a leading end portion of a waveform segment following each preceding waveform segment of the cut out waveform segments is determined commonly between the channel signals, based on two portions of a waveform of a synthesized signal formed by synthesizing the channel signals within a range of predetermined search parameters of the waveform of the synthesized signal. The two portions correspond to a time period over which cross-fading is to be carried out and are most similar to each other. The preceding waveform segment and the following waveform segment cut from each channel signal are spliced together by cross-fading a trailing end portion of the preceding waveform segment and the leading end portion of the following waveform segment.

7 Claims, 9 Drawing Sheets

TIME-AXIS COMPRESSION/EXPANSION METHOD AND APPARATUS FOR MULTICHANNEL SIGNALS

BACKGROUND OF THE INVENTION

1. Field of the Invention

This invention relates to a time-axis compression/expansion method and apparatus for performing time-axis compression/expansion on original digital signals at a desired compression/expansion rate without changing the pitch of the original digital signals, and more particularly to a time-axis compression/expansion method and apparatus of this kind which is suitable for processing multichannel signals.

2. Prior Art

The time-axis compression/expansion technique for time-axis compressing or time axis-expanding a digital audio signal without changing the pitch of the same is utilized e.g. for so-called "time length adjustment" for adjusting a total recording time period over which the digital audio signal is to be recorded to a predetermined time period, tempo conversion in a karaoke apparatus or the like, and so forth. Conventionally, this kind of time-axis compression/expansion technique includes a cut-and-splice method (as disclosed e.g. in Japanese Laid-Open Patent Publication (Kokai) No. 10-282963), an overlap-add method based on pointer shift amount control (Morita & Itakura, "Expansion/Compression of Sound in Time Product by Using Overlap-Add Method Based on Point Shift Amount Control and Its Evaluation", Lectures at the Autumn Conference of the Acoustical Society of Japan Vol. 1-4-14, p. 149, October, 1986), etc.

Time-axis compression/expansion processing by a general cut-and-splice method is performed such that waveform segments are cut out without considering correlation between the waveform segments and then the cut-out waveform segments are spliced together to thereby effect compression/expansion based on a specified compression/expansion rate. According to this method, discontinuities can occur in spliced portions of the cut-out waveform segments, and therefore cross-fading is carried out to smooth the spliced portions of the cut-out waveform segments. The time interval of the waveform cutout is set to such a time period that the human ears cannot sense an echo or doubling of sounds, e.g. approximately 60 msec. Particularly, according to the method disclosed in Japanese Laid-Open Patent Publication (Kokai) No. 10-282963, the cutout length or length of the cutout waveform segment is determined in synchronism with sound timing information. This method is distinguished from other conventional methods in that spliced portions appear at the same repetition period as that of the rhythm of the original waveform, so that tone changes at the spliced portions cannot be easily perceived. Cross-fading between waveform segments which are largely different in phase from each other markedly degrades the tone quality. Therefore, the present assignee has proposed a phase-matching type cut-and-splice method in which cut-out waveform segments which are closest in phase to each other are detected and are then subjected to cross-fading.

On the other hand, the overlap-add method based on pointer shift amount control is performed such that two adjacent segments of the original audio signal closely correlated in waveform and equal in length to each other are extracted, and the two signal segments are overlapped or added together. Then, the two original signal segments are replaced by a new signal segment obtained by the overlapping/addition, or the new signal segment is inserted between the two original signal segments, whereby the total time of the original audio signal is reduced or increased. This method enables smoother splicing of waveforms than the cut-and-splice method. Particularly, this method can achieve higher-quality time-axis compression/expansion of pitch-based sound source signals, such as voice signals and sound signals generated by monophonous musical instruments.

However, the conventional phase-matching type cut-and-splice method and overlap-add method based on pointer shift amount control only deal with monophonic signals. If these methods, which select signal segments identical in phase or signal segments closely correlated in waveform to each other for cross-fading, are directly applied to processing of stereo signals, it may provide an odd auditory localization for the listener, which forms a serious problem. This results from the fact that left-channel and right-channel signals are processed as separate monophonic signals independent from each other so that a disagreement occurs between the cross-faded portions of the signals of the respective channels, causing a difference in phase between tones sensed by the two ears that determines the auditory localization of the stereo signal.

Aside from the time-axis compression/expansion apparatus, there have been proposed pitch conversion devices that perform processing for changing the readout ratio by using the cut-and-splice method (Japanese Laid-Open Patent Publication (Kokai) No. 5-297891). According to one of the devices, pitch conversion of left-channel and right-channel signals of a stereo signal is performed such that portions of the left-channel signal most closely correlated to each other are cut out and spliced together by cross-fading, and then portions of the right-channel signal close to the edited point of the left-channel signal and most closely correlated to each other are cut out and spliced together by cross-fading. According to another device, the pitch conversion is performed such that the editing method is switched, as required, according to the correlation between the left-channel signal and the right-channel signal in such a manner that if the correlation between the two channel signals is not high, portions of each channel signal which are most closely correlated to each other are edited on a channel-by-channel basis, while if the correlation between the two channel signals is high, portions of the left-channel signal (or right-channel signal) which are most closely correlated to each other and portions of the other channel signal corresponding to the portions of the left-channel signal (or right-channel signal) are both edited.

However, these proposed devices had the disadvantage that cross-fading is not fully synchronized between the left and right channel signals, which may cause a difference in phase between tones sensed by the two ears and hence provide an odd auditory localization for the listener. Such a transient odd auditory localization that is sensed is generally more conspicuous to the ears than improper splicing of waveform segments by cross-fading, which forms a problem to be solved.

SUMMARY OF THE INVENTION

It is an object of the present invention to provide a time-axis compression/expansion method and apparatus for multichannel signals, which is capable of performing time-axis compression/expansion on a multichannel signal without causing a disagreement between cross-fading points of the channels of the multichannel signal, to thereby ensure that a normal auditory localization is provided for the listener.

To attain the above object, according to a first aspect of the present invention, there is provided a time-axis compression/expansion method for time-axis compressing/expanding a multichannel signal comprising a plurality of channel signals at a specified compression/expansion rate, which comprises the steps of sequentially cutting out waveform segments from each of the channel signals, determining a cutting starting point of a leading end portion of a waveform segment of the cut out waveform segments following each preceding waveform segement of the cut out waveform segments, commonly between the channel signals, based on two portions of a waveform of a synthesized signal formed by synthesizing the channel signals within a range of a predetermined search starting point to a predetermined search ending point of the waveform of the synthesized signal, the two portions corresponding to a time period over which cross-fading is to be carried out and being most similar to each other, and splicing together the preceding waveform segment and the following waveform segment cut from each of the channel signals based on the determined cutting starting point, by cross-fading a trailing end portion of the preceding waveform segment and the leading end portion of the following waveform segment.

According to this method, when cut-out waveform segments are to be spliced together by cross-fading, a cutting starting point of a waveform segment following each preceding waveform segment is determined based on a synthesized signal formed by synthesizing all the channel signals constituting the multichannel signal, and waveform segments are sequentially cut out from respective channel signals based on the cutting starting point thus determined, and spliced together by cross-fading. Therefore, the cutting starting point can be made identical between all the channel signals, and at the same time, set to an averaged point of the optimum cutting starting points of all the channel signals (when one channel is dominant, it is set to a point mostly dependent on the dominant channel). Therefore, it is possible to carry out time-axis compression/expansion without degrading tone quality at the spliced portions of waveform segments, and at the same time preventing displacement of cross-faded portions between the channel signals, thereby ensuring a natural auditory localization for the listener.

Preferably, the cutting starting point of each of the channel signal corresponds to a starting point of a following one of the two portions of the waveform of the synthesized signal which are most similar to each other.

Preferably, the length of each of the waveform segments to be cut out from each of the channel signals is set according to the specified compression/expansion rate.

Preferably, as the specified compression/expansion rate is farther from a value of "1", the time period over which the cross-fading is to be carried out is set to a longer time period.

Preferably, a frequency of calculating a degree of similarity of the two portions of the waveform of the synthesized signal is set according to the time period over which the cross-fading is to be carried out.

To attain the above object, according to a second aspect of the present invention, there is provided a time-axis compression/expansion apparatus for time-axis compressing/expanding a multichannel signal formed of a plurality of channel signals at a specified compression/expansion rate, which comprises a plurality of waveform segment-cutting sections that each sequentially cut out waveform segments from each of the channel signals, a cutting starting point-determining section that determines a cutting starting point of a leading end portion of a waveform segment of the cut out waveform segments following each preceding waveform segment of the cut out waveform segments, commonly between the channel signals, based on two portions of a waveform of a synthesized signal formed by synthesizing the channel signals within a range of a predetermined search starting point to a predetermined search ending point of the waveform of the synthesized signal, the two portions corresponding to a time period over which cross-fading is to be carried out and being most similar to each other, and a splicing section that splices together the preceding waveform segment and the following waveform segment cut from each of the channel signals based on the determined cutting starting point, by cross-fading a trailing end portion of the preceding waveform segment and the leading end portion of the following waveform segment.

The time-axis compression/expansion apparatus according to the second aspect of the invention can provide substantially the same effects as described as to the time-axis compression/expansion method according to the first aspect of the invention.

To attain the above object, according to a third aspect of the invention, there is provided a storage medium storing a program which can be executed by a computer, for realizing a time-axis compression/expansion method for time-axis compressing/expanding a multichannel signal formed of a plurality of channel signals at a specified compression/expansion rate, the program comprising a waveform segment-cutting module that sequentially cut out waveform segments from each of the channel signals, a cutting starting point-determining module that determines a cutting starting point of a leading end portion of a waveform segment of the cut out waveform segments following each preceding waveform segment of the cut out waveform segments, commonly between the channel signals, based on two portions of a waveform of a synthesized signal formed by synthesizing the channel signals within a range of a predetermined search starting point to a predetermined search ending point of the waveform of the synthesized signal, the two portions corresponding to a time period over which cross-fading is to be carried out and being most similar to each other, and a splicing module that splices together the preceding waveform segment and the following waveform segment cut from each of the channel signals based on the determined cutting starting point, by cross-fading a trailing end portion of the preceding waveform segment and the leading end portion of the following waveform segment.

The storage medium according to the third aspect of the invention can provide substantially the same effects as described above as to the time-axis compression/expansion method according to the first aspect of the invention.

The above and other objects, features, and advantages of the invention will become apparent from the following detailed description taken in conjunction with the accompanying drawings.

DETAILED DESCRIPTION

The present invention will now be described in detail with reference to drawings showing an embodiment thereof.

Figure 1:
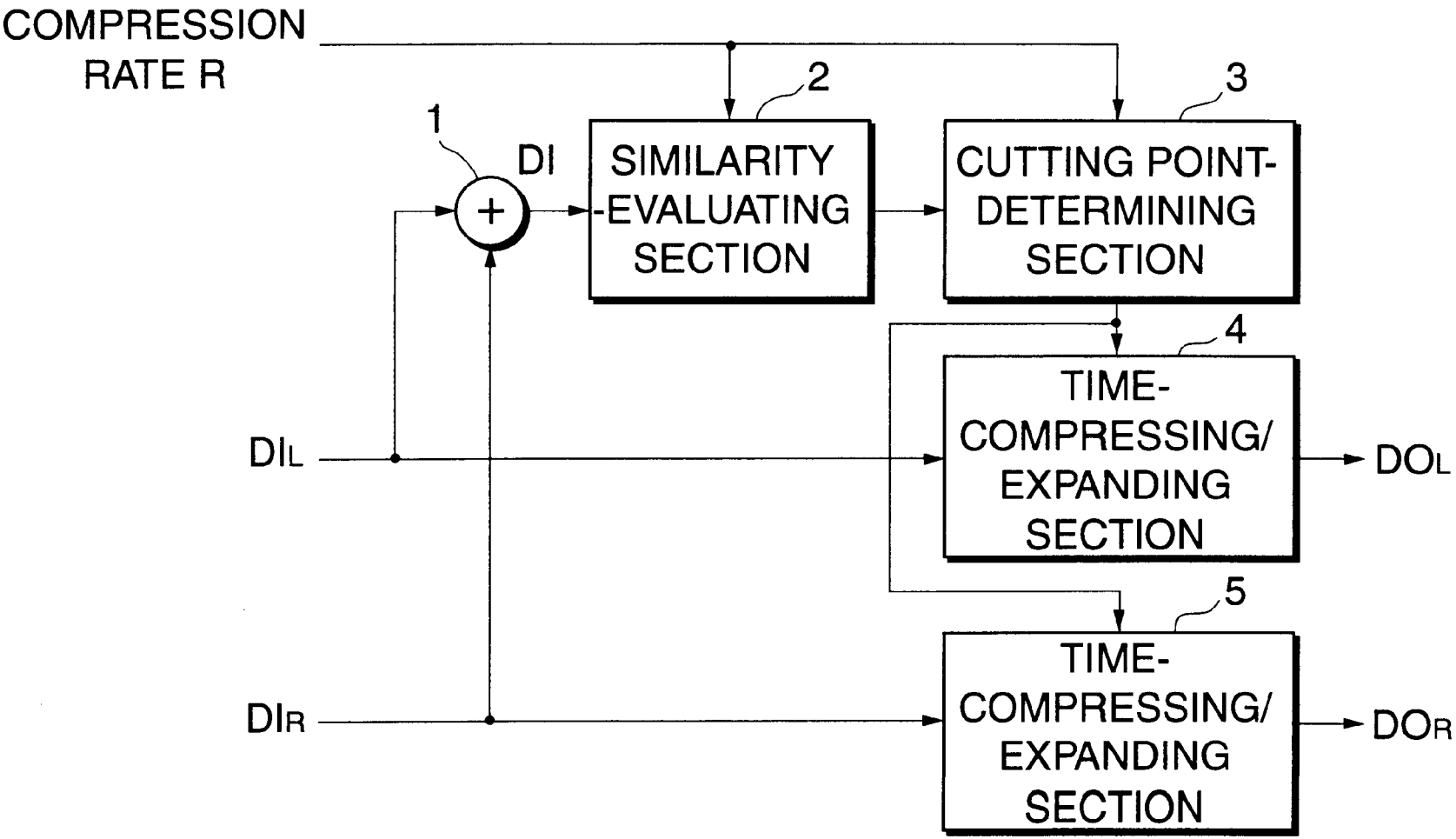
FIG. 1 is a block diagram showing the arrangement of a time-axis compression/expansion apparatus for performing time-axis compression/expansion on a stereo signal, according to an embodiment of the present invention.

Referring first to FIG. 1, there is shown the arrangement of a time-axis compression/expansion apparatus for performing time-axis compression/expansion on a stereo signal, according to an embodiment of the invention.

An audio stereo signal as original digital data to be time-axis compressed/expanded has its left channel (L-channel) signal $DI_L$ and right channel (R-channel) signal $DI_R$ synthesized by an adder 1, and the synthesized signal DI is supplied to a similarity-evaluating section 2. The similarity-evaluating section 2 includes a waveform memory, not shown, for storing the synthesized signal DI and calculates a similarity between waveform segments to be cross-faded, that are within a range from a predetermined search starting point to a predetermined search ending point of the synthesized signal DI, based on a given compression/expansion rate R. The similarity obtained by the similarity-evaluating section 2 is supplied to a cutting point-determining section 3. The cutting point-determining section 3 determines a cutting starting point at which the supplied similarity is the maximum (i.e. the difference between the waveform segments is the minimum), based on the given compression/expansion rate R. On the other hand, the L-channel and R-channel signals $DI_L$ and $DI_R$ are input separately to respective time-axis compressing/expanding sections 4, 5. The time-axis compressing/expanding sections 4, 5 carry out time-axis compression/expansion according to the compression/expansion rate R by cutting out waveform segments from the respective L and R channel signals, according to the cutting starting point determined based on the synthesized signal DI and commonly applied to the two channels, and splicing the respective cut-out waveform segments together by cross-fading.

Figure 2:
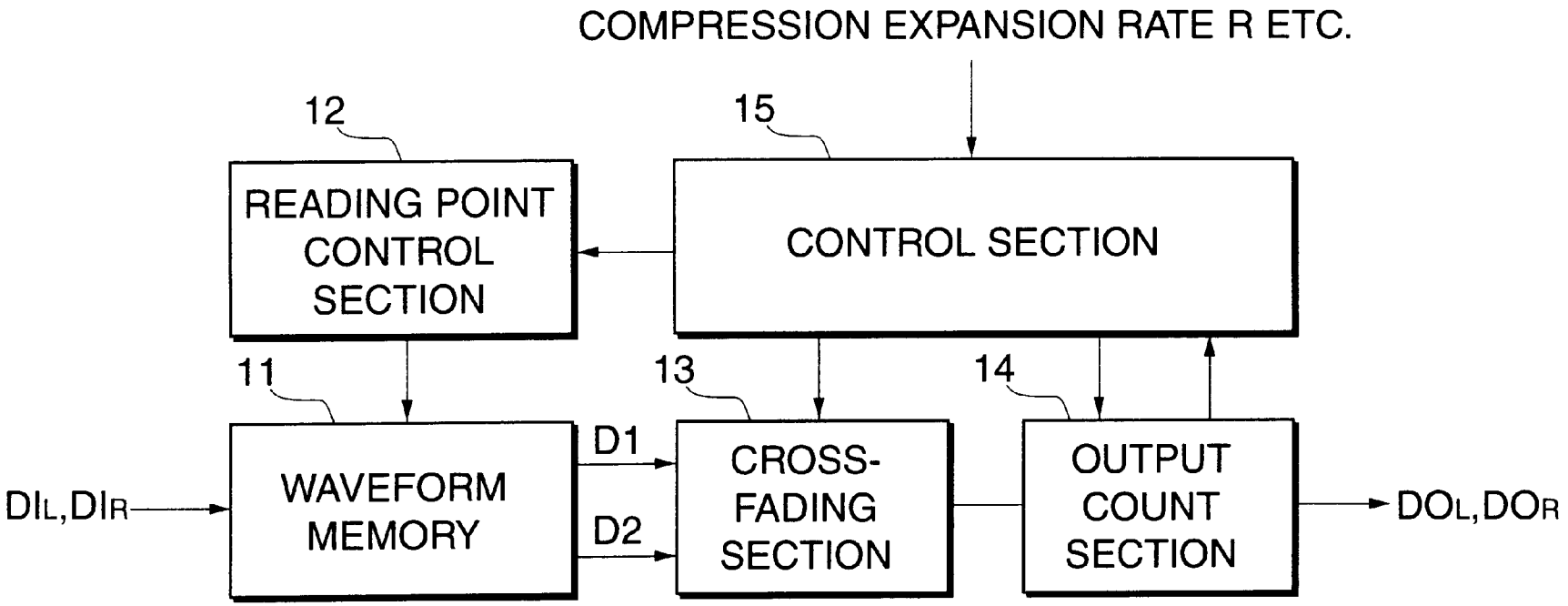
FIG. 2 is a block diagram showing the arrangement of a time-axis compressing/expanding section of the time-axis compression/expansion apparatus.

FIG. 2 shows the arrangement of the time-axis compressing/expanding section 4 (5) of the FIG. 1 apparatus.

L(R)-channel signals $DI_L(DI_R)$ to be time-axis compressed/expanded are sequentially stored in a waveform memory 11. Each of the signals $DI_L(DI_R)$ stored in the waveform memory 11 is sequentially read out as two kinds of data D1, D2 starting from respective designated cutting starting points, which are to be spliced together over a predetermined data length, under control of a reading point control section 12. The data D1, D2 read out from the waveform memory 11 are delivered to a cross-fading section 13, where they are cross-faded. The data cross-faded by the cross-fading section 13 are output as a compressed/expanded output signal $DO_L(DO_R)$ via an output count section 14 which counts the number of data contained in the output signal. A control section 15 determines a time period over which cross-fading of cutout waveform segments is carried out, a search range, etc., based on the compression/expansion rate R designated from outside, and also determines a cut-out data length based on a cutting starting point given by the cutting point-determining section 3. Further, the control section 15 sets the determined cut-out data length to the output count section 14. Then, after the cut-out data length has been counted up by the output count section 14, the control section 15 controls the sections 12 to 14 to execute a search for a cutting starting point of the following waveform segment to be cut out.

Next, description will be made of the operation of the time-axis compression/expansion apparatus constructed as above.

Figures 3A, 3B, 3C:
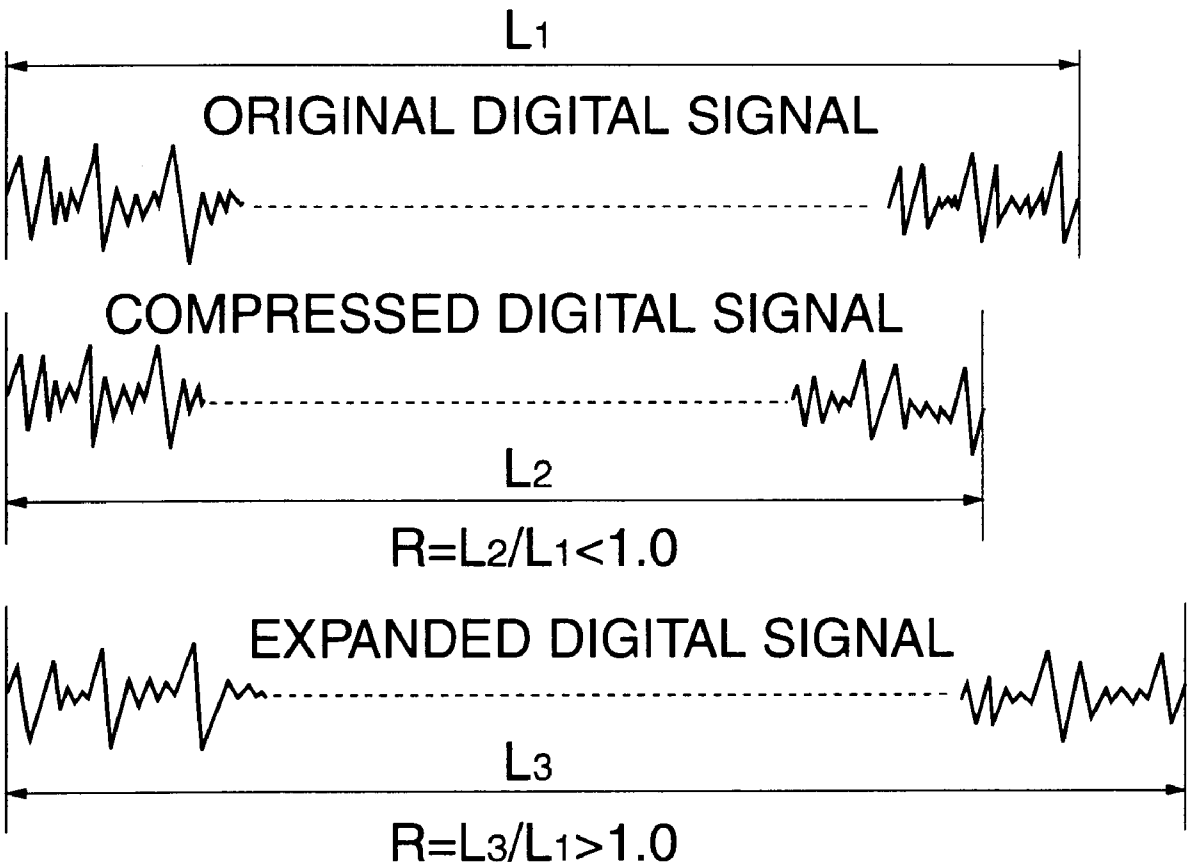
FIGS. 3A to 3C are diagrams which are useful in explaining a compression/expansion rate for use in compressing/expanding a digital signal.

FIGS. 3A to 3C are diagrams which are useful in explaining the compression/expansion rate R. As shown in FIGS. 3A and 3B, if the length of an original digital signal is designated by L1, and the length of an output digital signal is designated by L2 (L2<L1), the compression/expansion rate R can be defined by an equation of R=L2/L1. Since in the example of FIGS. 3A and 3B, the ratio R is less than 1.0, the output digital signal L is compressed digital data formed by time-axis compression. On the other hand, as shown in FIG. 3C, if the output digital data has a length designated by L3 (L3>L1), R (=L3/L1)>1.0 holds, and the output digital signal is expanded digital data formed by time-axis expansion. For the purpose of time length adjustment or the like, an original digital signal is compressed or expanded with respect to the time axis (time-axis compressed or time-axis expanded) so as to be equal to a desired recording time period of the output digital signal, and hence the compression/expansion rate R is determined from the recording time period of the original digital signal recorded in advance and the desired recording time period.

Figure 4:
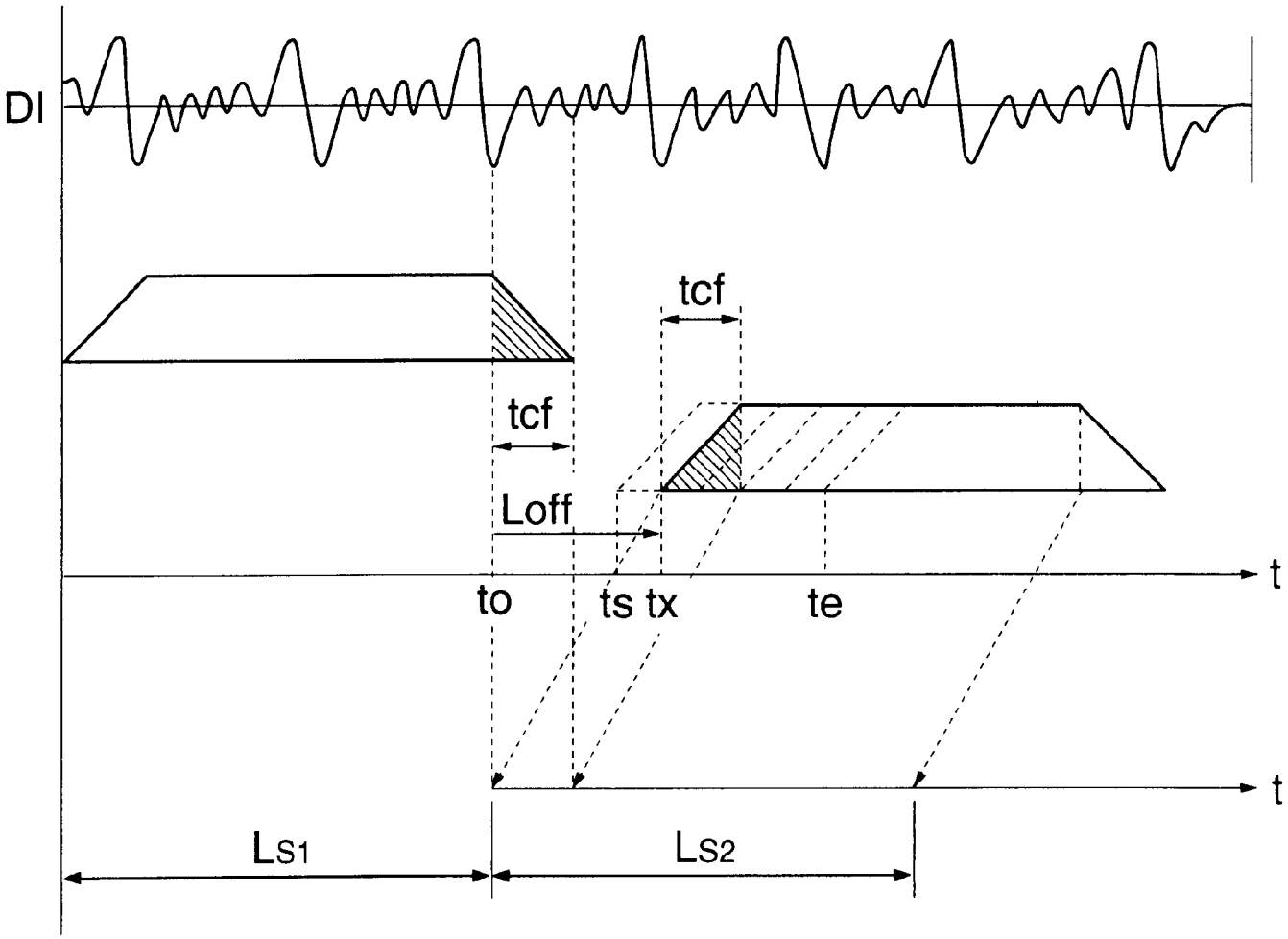
FIG. 4 is a diagram which is useful in explaining time-axis compression carried out by the time-axis compression/expansion apparatus.
Figure 5:
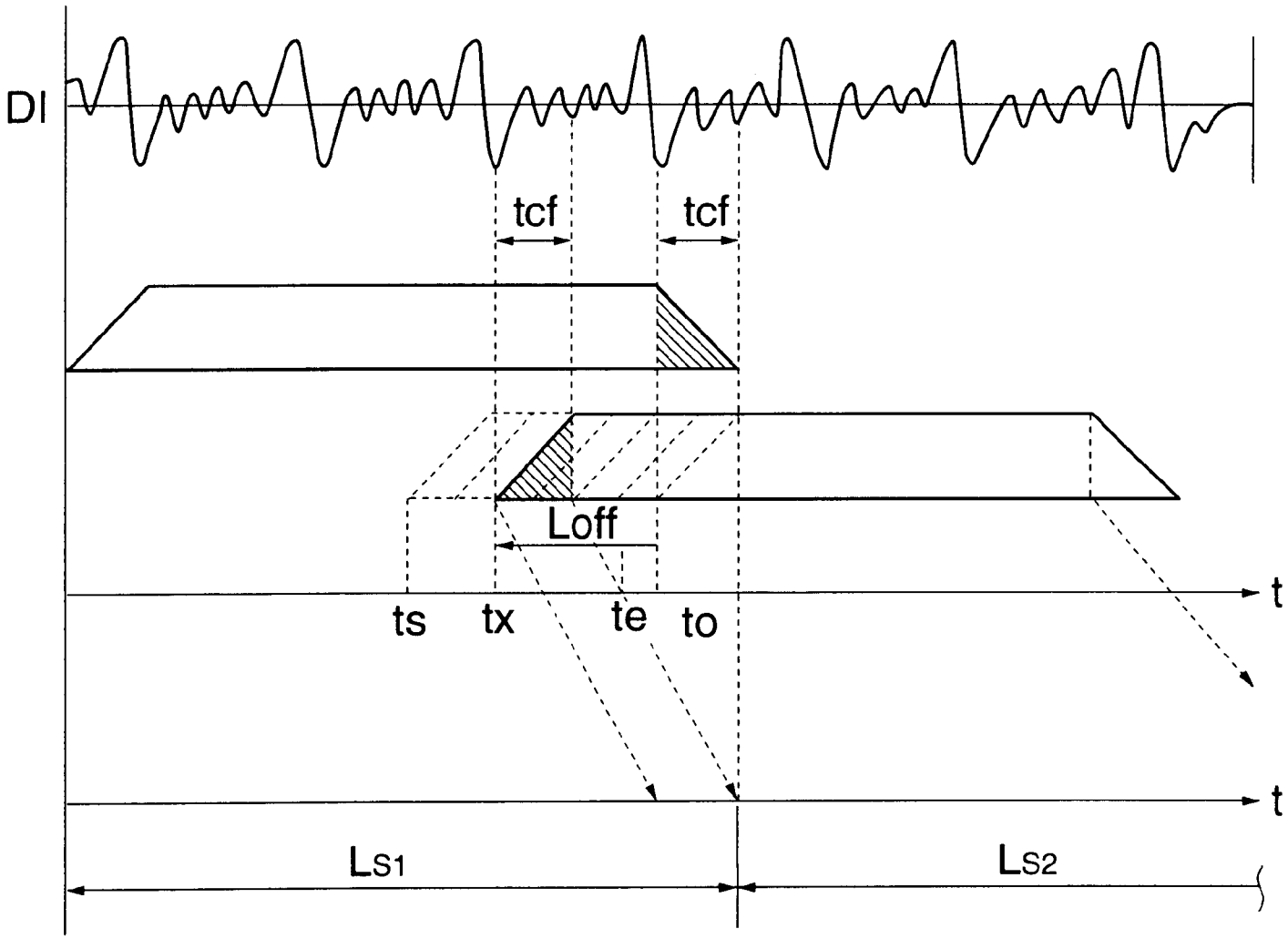
FIG. 5 is a diagram which is useful in explaining time-axis expansion carried out by the time-axis compression/expansion apparatus.

Alternatively, the compression/expansion rate R may be expressed in terms of cut-out length Ls of waveform segments and length Loff of offset between the trailing end of a cut-out waveform segment and the leading end of the following cut-out waveform segment, so that even if the offset length Loff changes, it is possible to change the cut length Ls in accordance with the change in the offset length Loff, so as to keep the compression/expansion rate R constant. Accordingly, in the present embodiment, waveform segments are cut out as shown in FIG. 4, for time-axis compression, and as shown in FIG. 5, for time-axis expansion. More specifically, the leading end of a waveform segment to be cut out from the waveform of each channel signal is searched over the signal DI formed by synthesizing the left and right channel signals, from a predetermined search starting point ts to a predetermined search ending point te, to determine a point tx at which the highest similarity is shown based on a waveform of the signal DI between a trailing end portion of a present waveform segment corresponding to a cross-fading time period tcf and a leading end portion (which starts from the point tx) of the following waveform segment to be cut-out corresponding to the same time period tcf, whereby the following waveform segment having the leading end portion starting from the point tx is cut out. If the point tx is set as the cutting starting point as described above, the similarity S(x) between the cross-faded portions of the waveform segments can be determined from a sum of squares of the difference in waveform between the two cross-fading portions, by the following equation (1):

$$S(x) = \sum_{f=0}^{tcf} \{DI(t0+i) - DI(tx+i)\}^2 \quad (1)$$

This is just an example, and, needless to say, the similarity S(x) may be determined from a sum of absolute values of the difference.

When the cutting starting point tx is determined, the length of the following waveform segment to be cut out is determined. More specifically, assuming that the offset length which was determined (i−1)th time is designated by Loffi−1, the length Lsi of the following waveform segment to be cut out can be calculated by using the following equation (2):

$$Lsi=R/(1-R)\cdot Loffi-1 \quad (2)$$

(R≠1; when Loffi−1>0: compression when Loffi−1<0: expansion)

It is desired that regardless of whether the above equation is used, a minimum cut length Lsmin is provided, and the cut length Lsi is set to a value equal to or longer than the minimum cut length Lsmin. For instance, if the minimum frequency is 50 Hz, the minimum cut length Lsmin is set to 20 msec. Further, the search range ts−te is set to approximately 20 msec in correspondence to the minimum cut length Lsmin. More specifically, the search starting point ts and the search ending point te can be set e.g. to 5 msec and 25 msec, respectively.

It should be noted that as the compression/expansion rate deviates farther from "1" (i.e. the compression or expansion ratio becomes higher), the output digital signal becomes less similar to its original digital signal so that spliced portions of waveform segments can be unnatural. To avoid this problem, it is preferable to change the cross-fading time period tcf such that it becomes longer as the compression/expansion rate farther deviates from "1". More specifically, e.g. when the compression ratio is 50% or when the expansion ratio is 200%, the cross-fading time period tcf is set to approximately 50% of the cut length Lsi, and the ratio of the cross-fading time period tcf to the cut length Lsi is progressively reduced such that it becomes closer to 0% as the compression/expansion rate becomes closer to 100%.

Further, when the cross-fading time period tcf is long, a long time period is required for calculating the similarity.

Therefore, the step width of calculation of the similarity may be changed according to the cross-fading time period tcf so as to save the calculation time. For instance, when the compression ratio is 50% or when the expansion ratio is 200%, the similarity may be calculated by comparing data every 3 to 5 samples, and the data comparison frequency is progressively increased toward every one sample as the compression/expansion rate approaches 100%. In view of possible purposes for which the similarity between portions of waveform segments to be cross-faded is determined, it is only required to obtain the correlation between the pitch waveforms whose amplitude levels change sharply, and therefore it is not necessary to give much attention to small changes in the pitch waveforms. Therefore, the above-mentioned method of changing the step width will not bring about a large difference in the similarity determination result.

Figure 6:
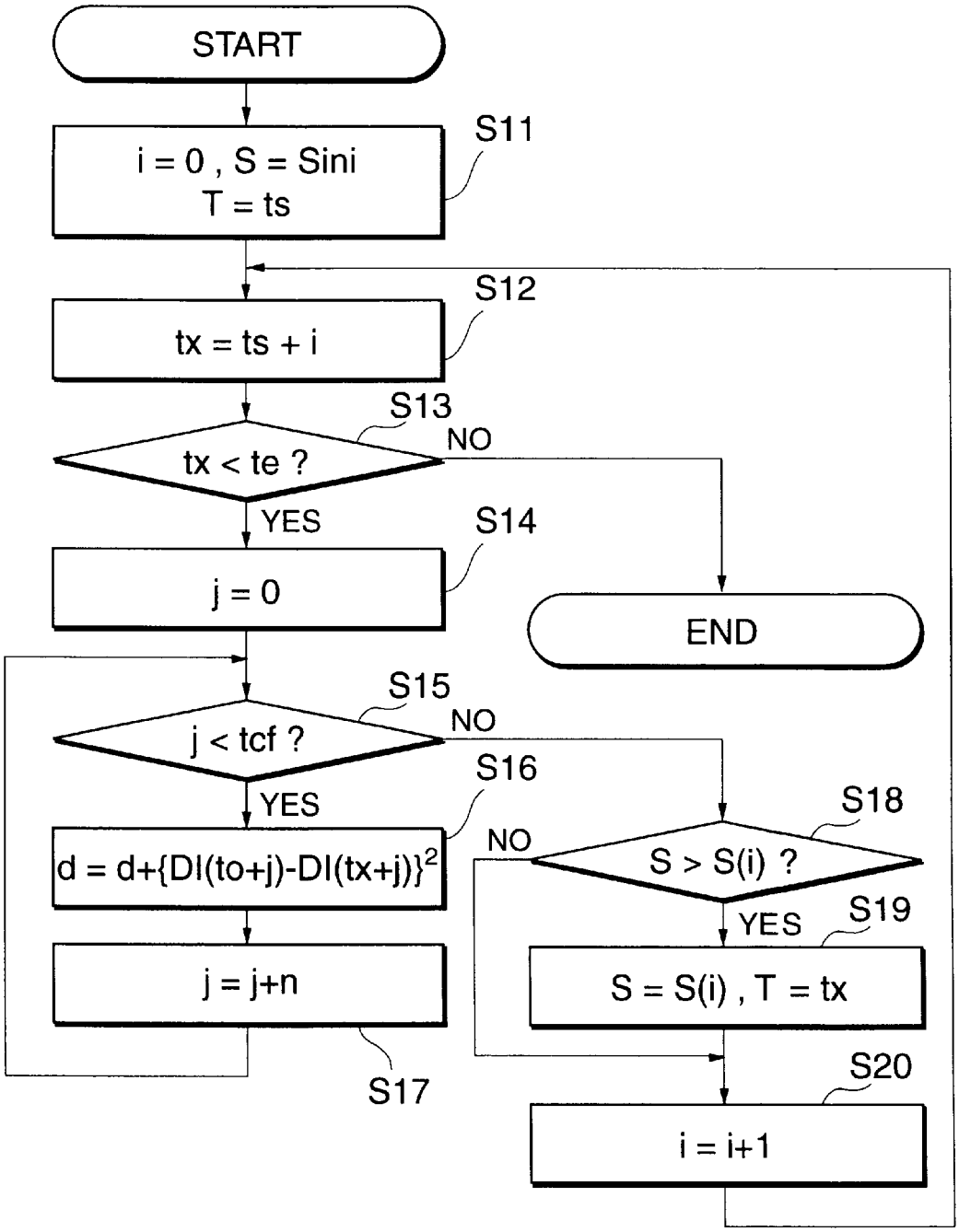
FIG. 6 is a flowchart showing a routine for calculating a similarity and determining a cutting starting point.

FIG. 6 shows a routine for calculating the similarity and determining the cutting starting point. First, at a step S11, a parameter i for use in searching the cutting starting point is reset to "0", a parameter S indicative of the similarity is set to an initial value Sini, and the present point T in time is set to the search starting point ts. Then, at a step S12, the cutting starting point tx is set to ts+i, and if the cutting starting point tx does not reach the search ending point te (step S13), a calculation is carried out by changing a parameter j from 0 to tcf at steps S14 to S17, by the using the following equation (3):

$$d=d+\{DI(t0+j)-DI(tx+j)\}2 \quad (3)$$

where d indicates the difference in waveform.

If a parameter S(i) equal to the reciprocal of the parameter d indicative of the difference in waveform obtained by the above calculation is larger than the parameter S, the parameter S is updated to S(i), and the present or maximum similarity point T to tx at respective steps S18 and S19. Then, at a step S20, the parameter i is updated or incremented by "1", and the program returns to the step S12, wherein the cutting starting point tx is set to ts+i. When the cutting starting point tx reaches the search ending point te at the step S13, the program is terminated. Thus, the cutting starting point which provides the maximum similarity is eventually stored as the maximum similarity point T.

Figure 7:
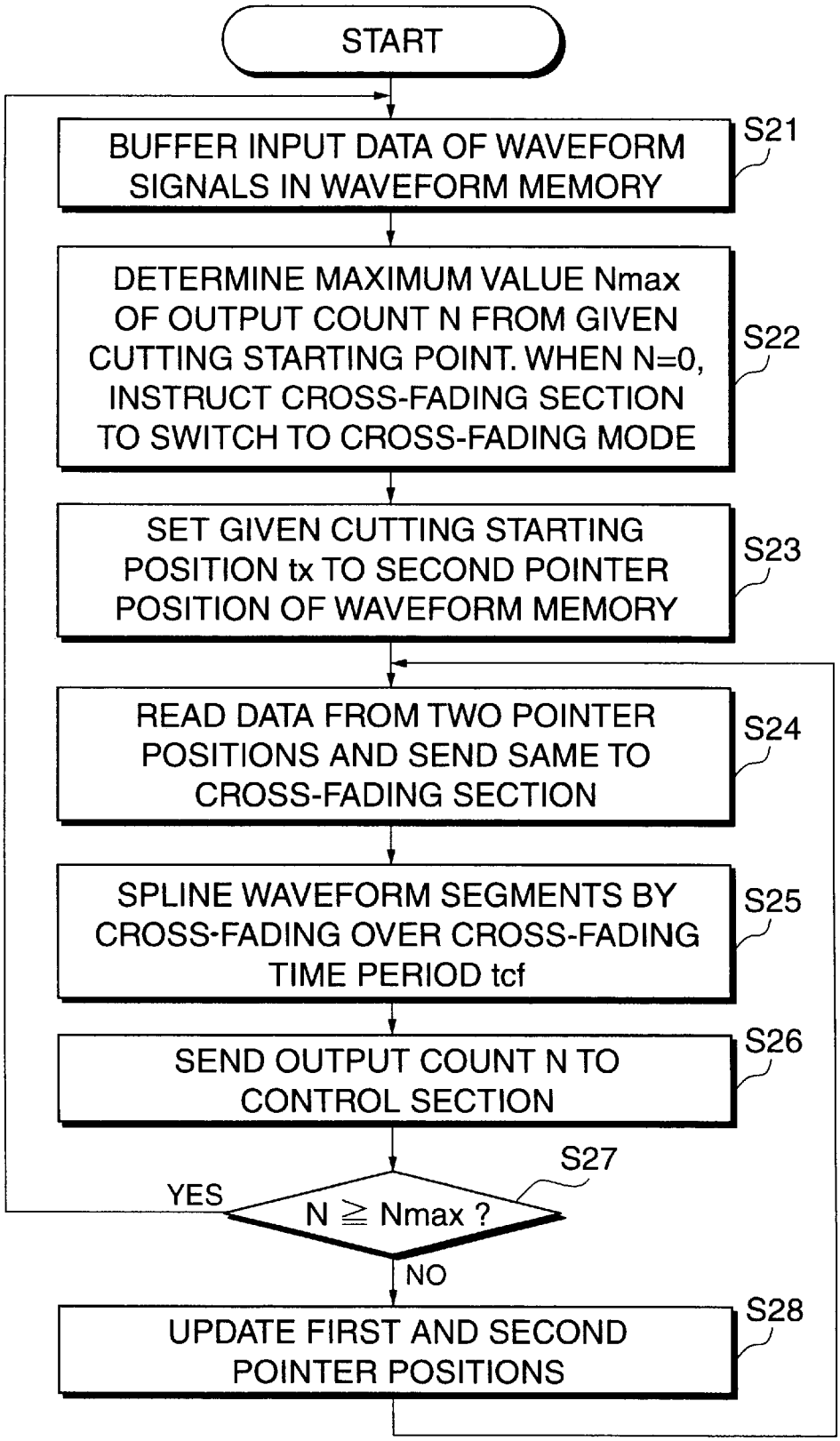
FIG. 7 is a flowchart showing a routine for carrying out time-axis compression/expansion.

FIG. 7 shows a routine for carrying out time-axis compression/expansion on the original digital signal by the time-axis compression/expansion apparatus according to the present embodiment.

First, at a step S21, data of the original digital signal waveform of a corresponding channel is buffered in the waveform memory 11 at least in an amount required for search of the cutting starting point.

At the following step S22, the control section 15 calculates the cut length Ls of a waveform segment to be cut out from the cutting starting point tx given by the cutting point-determining section 3, and stores the obtained cut length Ls as a maximum value Nmax of the output count. At the same time, the control section 15 instructs the cross-fading section 13 to switch to an operational mode for cross-fading.

Figure 8A:
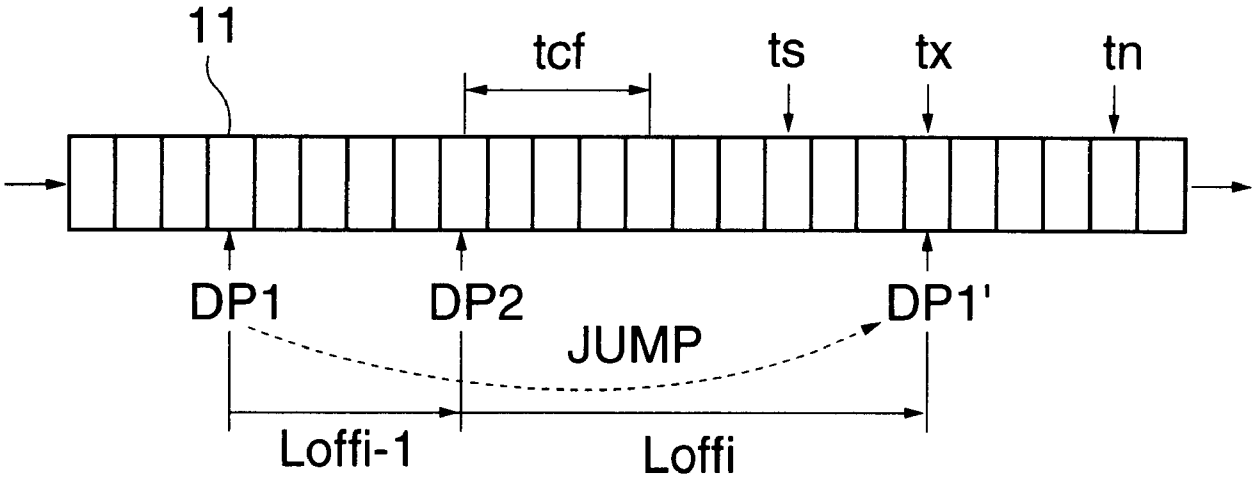
FIGS. 8A and 8B are diagrams which are useful in explaining control of a waveform memory by a reading point control section.
Figure 8B:
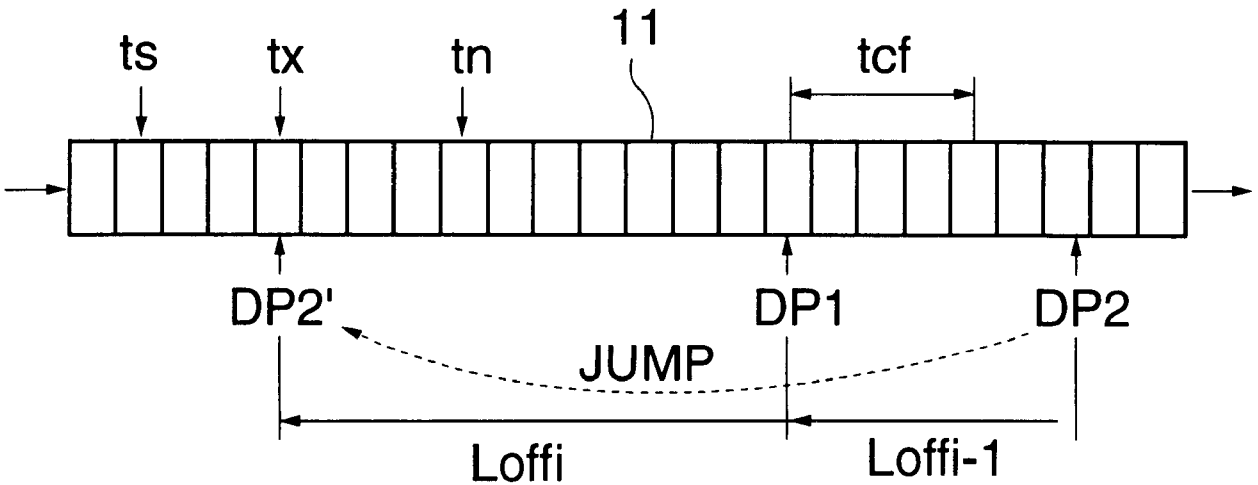

Then, at a step S23, the reading point control section 12 sets a second pointer position of the waveform memory 11, based on the given cutting starting point tx. More specifically, for time-axis compression, as shown in FIG. 8A, data D1, D2 are read out from the waveform memory 11 by first and second pointers DP1 and DP2 of the waveform memory 11, with the offset length Loffi−1 maintained therebetween. When the preceding or first pointer DP2 has reached the trailing end point (cross-fading start point of the trailing end portion) of a waveform segment to be cut out, the next cutting starting point tx is determined. At this time, the other or second pointer DP1 which has been behind the pointer DP2 jumps to a point DP1', and then the two pointers DP1', DP2 move simultaneously with a new offset length Loffi−1 maintained therebetween. On the other hand, for time-axis expansion, a pointer jumps not forward, but backward, as shown in FIG. 8B. The data D1, D2 are read out, respectively, from the waveform memory 11 at points indicated by the two pointers. The data D1, D2 read out are sent to the cross-fading section 13 at a step S24.

Figure 9A:
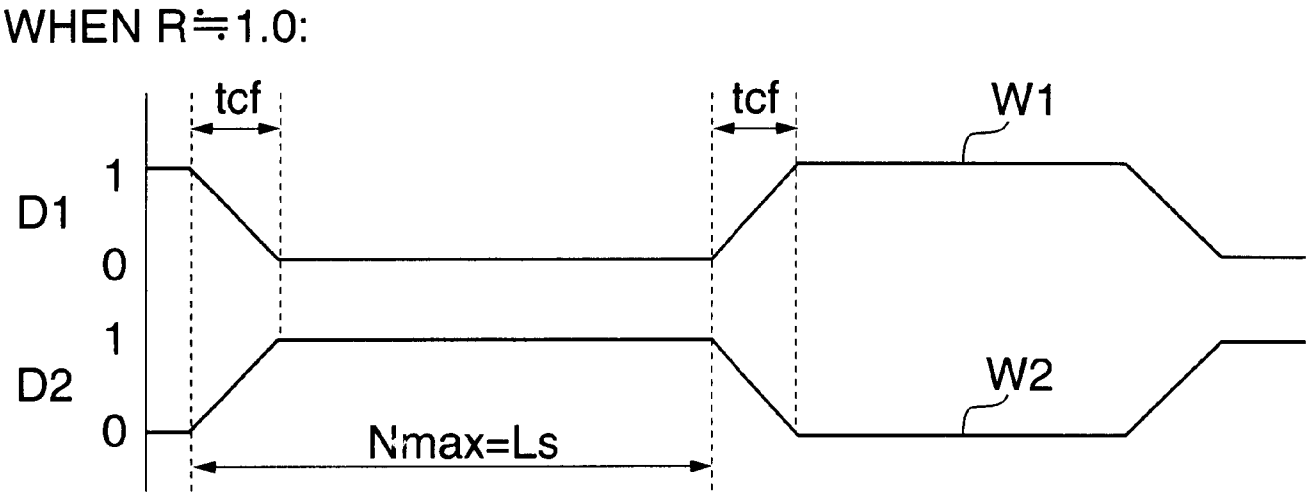
FIGS. 9A and 9B are diagrams which are useful in explaining cross-fading.
Figure 9B:
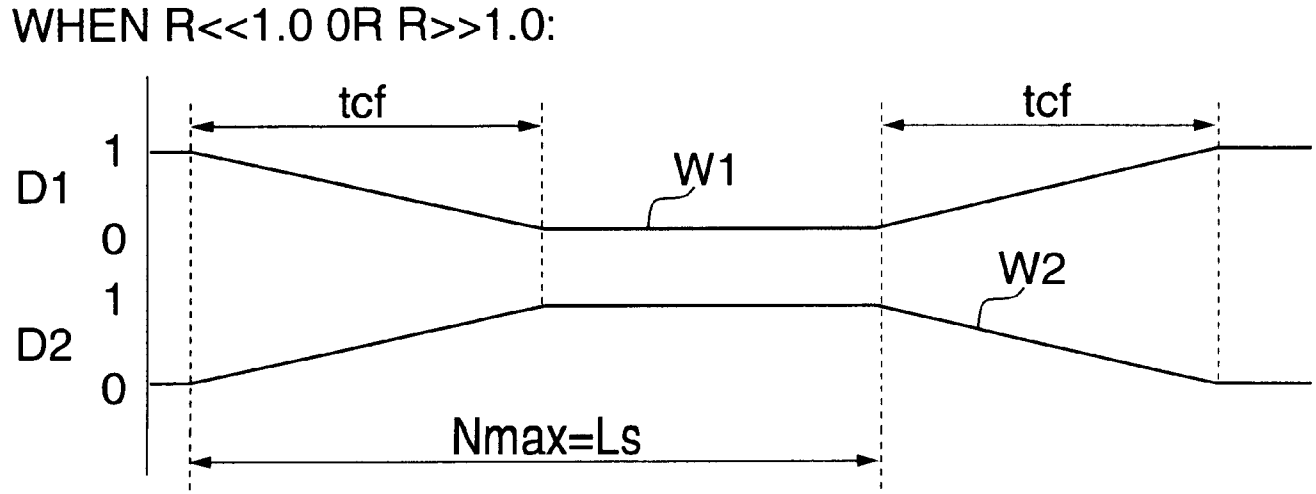

The cross-fading section 13 executes cross-fading synthesis processing based on the cross-fading time period tcf determined by the control section 15. More specifically, as shown in FIGS. 9A and 9B, the data D1 is multiplied by a cross-fade coefficient W1, and the data 2 by a cross-fade coefficient W2, and then the multiplied data D1, D2 are added together to generate synthesized data (S25). The coefficients W1, W2 are set to satisfy a condition of W1+W2=1.0. FIG. 9A shows the cross-fade coefficients W1, W2 in the case of the compression/expansion rate R being close to "1", while FIG. 9B shows the same in the case of the compression/expansion rate R being far from "1" (e.g. R=0.5, or R=2.0). The obtained synthesized data is sent to the output count section 14 at a step S25.

At a step S26, the output count section 14 counts an output count value N of the synthesized data and then sends the count value N to the control section 15. At the following step S27, the control section 15 determines whether or not the output count value N has reached the maximum output count value Nmax. If the output count value N has not reached the maximum output count value Nmax, the pointers DP1, DP2 are each updated at a step S28, followed by the program returning to the step S24. At the step S24, the following data items D1, D2 are read out for repeatedly carrying out the cross-fading at the steps S25 to S27. If the output count value N has reached the maximum output count value Nmax at the step S27, the program returns to the step S21, wherein data of the original digital signal required for a search of the next cutting starting point is buffered in the waveform memory 11, and then the same processing as described above is carried out at the following steps S22 to S28.

As described above, according to the time-axis compression/expansion apparatus of the present embodiment, two adjacent portions of a synthesized signal DI formed by synthesizing signals of all channels are searched which are similar in waveform to each other and correspond to portions to be cross-faded, and then the starting point of the following one of the adjacent portions is determined as a cutting starting point of the next waveform segment to be cut out which are common to all the channels. At the same time, waveform segments are cut out such that a specified compression/expansion rate can be maintained. As a result, a natural auditory localization can be maintained, and at the same time waveform segments can be spliced together smoothly. Thus, excellent time-axis compression/expansion of a stereo signal can be achieved to generate sound without any odd auditory localization. Further, according to the time-axis compression/expansion apparatus of the present embodiment, the cross-fading time period tcf can be changed according to the compression/expansion rate, so that even when the compression or expansion ratio is high, it is possible to splice together waveform segments smoothly.

It should be noted that the present invention is not limited to the above described embodiment.

Although in the above described embodiment, the multichannel signal to be processed is a digital audio signal having left and right channels, i.e. a two-channel signal, it goes without saying that the invention is applicable to compression/expansion of a so-called surround stereo signal having three or more channels. For instance, when a 5-channel signal such as an AC3 signal is to be processed, a synthesized signal may be formed by adding all or some of signals of respective channels, and a cutting starting point of a waveform of the signal of each channel to be processed may be determined based on the synthesized signal. Then, waveform segments of the respective channels may be cut out uniformly at the cutting starting point for splicing by cross-fading.

Further, although in the above embodiment, a trapezoidal window function is used as a window function for cross-fading processing, the use of another function, such as a Gaussian window, a humming window, etc. can provide substantially the same effects.

Further, it goes without saying that the object of the present invention can be also attained by supplying a storage medium storing a software program implementing the functions of the embodiment described above to a system or apparatus, and causing the computer (or CPU or MPU) of the system or the apparatus to read the program stored in the storage medium for execution of the above-described processes.

In this case, the program itself read out from the storage medium implements the novel functions of the present invention, and hence the storage medium storing the program constitutes the present invention.

As the storage medium for supplying the program of the invention, there may be used a hard disk of a HDD (hard disk drive), a CD-ROM, an MO, an MD, a floppy disk, a CD-R (CD-recordable), a magnetic tape, a non-volatile memory card, a ROM, and so forth. Further, the program may be supplied from a server computer via an IEEE1394 device or a communication network.

Furthermore, it goes without saying that the invention encompasses not only a case in which the functions of the embodiment described above are realized by the computer which reads and executes the program, but also a case in which based on instructions of the program, a part or all of the operations are carried out by an operating system (OS) or the like running on the computer, and thereby realizing the functions of the embodiment described above.

Moreover, it goes without saying that the invention encompasses a case in which the program read out from the storage medium is once written in a memory provided in a function expansion board inserted in the computer or a function expansion unit connected to the computer, and based on instructions of the program, the CPU incorporated in the function expansion board or function expansion unit actually carries out a part or all of the above operations, thereby realizing the functions of the embodiment described above.

What is claimed is:

1. A time-axis compression/expansion method for time-axis compressing/expanding a multichannel signal comprising a plurality of channel signals at a specified compression/expansion rate, comprising the steps of:

sequentially cutting out waveform segments from each of the channel signals;

determining a cutting starting point of a leading end portion of a waveform segment of the cut out waveform segments following each preceding waveform segement of the cut out waveform segments, commonly between said channel signals, based on two portions of a waveform of a synthesized signal formed by synthesizing said channel signals within a range of a predetermined search starting point to a predetermined search ending point of said waveform of said synthesized signal, said two portions corresponding to a time period over which cross-fading is to be carried out and being most similar to each other; and splicing together said preceding waveform segment and said following waveform segment cut from each of said channel signals based on the determined cutting starting point, by cross-fading a trailing end portion of said preceding waveform segment and the leading end portion of said following waveform segment.

2. A time-axis compression/expansion method according to claim 1, wherein said cutting starting point of each of said channel signal corresponds to a starting point of a following one of said two portions of said waveform of said synthesized signal which are most similar to each other.

3. A time-axis compression/expansion method according to claim 1, wherein length of each of said waveform segments to be cut out from each of said channel signals is set according to said specified compression/expansion rate.

4. A time-axis compression/expansion method according to claim 1, wherein as said specified compression/expansion rate is farther from a value of "1", said time period over which said cross-fading is to be carried out is set to a longer time period.

5. A time-axis compression/expansion method according to claim 1, wherein a frequency of calculating a degree of similarity of said two portions of said waveform of said synthesized signal is set according to said time period over which said cross-fading is to be carried out.

6. A time-axis compression/expansion apparatus for time-axis compressing/expanding a multichannel signal formed of a plurality of channel signals at a specified compression/expansion rate, comprising:

a plurality of waveform segment-cutting sections that each sequentially cut out waveform segments from a corresponding one of said channel signals;

a cutting starting point-determining section that determines a cutting starting point of a leading end portion of a waveform segment of the cut out waveform segments following each preceding waveform segment of the cut out waveform segments, commonly between said channel signals, based on two portions of a waveform of a synthesized signal formed by synthesizing said channel signals within a range of a predetermined search starting point to a predetermined search ending point of said waveform of said synthesized signal, said two portions corresponding to a time period over which cross-fading is to be carried out and being most similar to each other; and a splicing section that splices together said preceding waveform segment and said following waveform segment cut from each of said channel signals based on the determined cutting starting point, by cross-fading a trailing end portion of said preceding waveform segment and the leading end portion of said following waveform segment.

7. A storage medium storing a program which can be executed by a computer, for realizing a time-axis compression/expansion method for time-axis compressing/expanding a multichannel signal formed of a plurality of channel signals at a specified compression/expansion rate, the program comprising:

a waveform segment-cutting module that sequentially cuts out waveform segments from each of said channel signals;

a cutting starting point-determining module that determines a cutting starting point of a leading end portion of a waveform segment of the cut out waveform segments following each preceding waveform segment of the cut out waveform segments, commonly between said channel signals, based on two portions of a waveform of a synthesized signal formed by synthesizing said channel signals within a range of a predetermined search starting point to a predetermined search ending point of said waveform of said synthesized signal, said two portions corresponding to a time period over which cross-fading is to be carried out and being most similar to each other; and a splicing module that splices together said preceding waveform segment and said following waveform segment cut from each of said channel signals based on the determined cutting starting point, by cross-fading a trailing end portion of said preceding waveform segment and the leading end portion of said following waveform segment.

* * * * *